US009159283B2

(12) United States Patent
Yamashita

(10) Patent No.: US 9,159,283 B2
(45) Date of Patent: Oct. 13, 2015

(54) SWITCH CIRCUIT, PIXEL ELEMENT AND DISPLAY PANEL FOR USING IN REFRESHING MEMORY IN PIXEL

(75) Inventor: Keitaro Yamashita, Hyogo (JP)

(73) Assignee: INNOLUX CORPORATION, Miao-Li County (TW)

( * ) Notice: Subject to any disclaimer, the term of this patent is extended or adjusted under 35 U.S.C. 154(b) by 410 days.

(21) Appl. No.: 13/185,126

(22) Filed: Jul. 18, 2011

(65) Prior Publication Data

US 2013/0021319 A1 Jan. 24, 2013

(51) Int. Cl.
*G09G 3/36* (2006.01)

(52) U.S. Cl.
CPC ..... *G09G 3/3618* (2013.01); *G09G 3/3648* (2013.01); *G09G 2300/0465* (2013.01); *G09G 2300/0809* (2013.01); *G09G 2300/0828* (2013.01); *G09G 2300/0842* (2013.01); *G09G 2300/0876* (2013.01)

(58) Field of Classification Search
CPC ..... G09G 2310/294; G09G 2300/0439
USPC ..... 345/87–104
See application file for complete search history.

(56) References Cited

U.S. PATENT DOCUMENTS

| | | | | |
|---|---|---|---|---|
| 2002/0075211 | A1* | 6/2002 | Nakamura | 345/87 |
| 2003/0016201 | A1* | 1/2003 | Ayres et al. | 345/98 |
| 2003/0016202 | A1* | 1/2003 | Edwards et al. | 345/98 |
| 2003/0052847 | A1* | 3/2003 | Okishiro et al. | 345/87 |
| 2006/0181495 | A1* | 8/2006 | Edward | 345/92 |
| 2009/0002582 | A1* | 1/2009 | Sano | 349/38 |
| 2009/0040174 | A1 | 2/2009 | Yamashita | |
| 2009/0128473 | A1 | 5/2009 | Yamashita et al. | |
| 2009/0284500 | A1 | 11/2009 | Yamashita | |
| 2010/0001970 | A1 | 1/2010 | Yamashita | |
| 2010/0085286 | A1 | 4/2010 | Yamashita et al. | |

FOREIGN PATENT DOCUMENTS

| | | |
|---|---|---|
| WO | WO 03/007286 | 1/2003 |
| WO | WO 03/009268 | 1/2003 |
| WO | WO 2004/090854 | 10/2004 |

OTHER PUBLICATIONS

Jeppson, K.O., "Influence of the Channel Width on the Threshold Voltage Modulation in M.O.S.F.E.T.S.", 1975, IEEE vol. 11, pp. 297-299.*

* cited by examiner

*Primary Examiner* — Sanghyuk Park
(74) *Attorney, Agent, or Firm* — Rabin & Berdo, P.C.

(57) ABSTRACT

A switch circuit, a pixel element and a display panel are provided. The switch circuit is for the pixel element, and includes switches. A switch is turned on to perform a sample operation on the pixel element. Another switch has a control terminal coupled to an image data storage capacitor of the pixel element via the switch, a data terminal to a corresponding source line, and another data terminal to the image data storage capacitor. During the sample operation, the second switch stores an image data of the image data storage capacitor in a parasitic gate capacitor existing on its control terminal. The parasitic gate capacitor maintains its stored data from the sample operation to a refresh operation in which the pixel element is refreshed. The second switch selectively electrically connects its two data terminals with each other according to stored image data in the parasitic gate capacitor.

17 Claims, 5 Drawing Sheets

SWITCH CIRCUIT, PIXEL ELEMENT AND DISPLAY PANEL FOR USING IN REFRESHING MEMORY IN PIXEL

BACKGROUND OF THE INVENTION

1. Field of the Invention

The invention relates in general to a switch circuit, a pixel element and a display panel using the same, more particularly to a switch circuit, a pixel element and a display panel using the same.

2. Description of the Related Art

In order to enhance the value of display devices such as a liquid crystal display (LCD), a technology of memory in pixel (MIP) has been introduced into various fields of application. MIP can be used to for example reduce power consumption of different display devices, such as a reflective or a transflective LCD.

There are different types of MIP. In order to achieve same bit number, a dynamic random-access memory (DRAM) type of MIP requires less circuit elements, as compared with that of a static random-access memory (SRAM) type of MIP. In other words, the DRAM type of MIP, such as a self-refreshing in pixel type MIP (SRP-MIP), has a reduced circuit complexity, and a higher transmissive aperture ratio than that of SRAM type of MIP. In view of this, the DRAM-based MIP is suitable for display devices which require high aperture ratio, or high resolution such as pixels per inch (PPI).

In most MIPs, a memory is used to maintain the gray level of the MIP without new data being provided from a source driver, so that power consumption can be reduced. The memory is for example such as a capacitor which is used for storing the state of an image data storage capacitor which stores with an image data. After the state of the image data storage capacitor is memorized in the memory, the image data storage capacitor can have its image data refreshed or maintained according to the memorized state.

In MIP, however, the layout area of its memory reduces the transparent or transmissive area in the whole pixel area. This affects the aperture ratio, as well as the resolution of display devices. Due to inverse relationship between the aperture ratio and the resolution, in a case where a display device requires a high resolution, the aperture ratio will become unacceptably small.

SUMMARY OF THE INVENTION

The invention is directed to a switch circuit, a pixel element and a display panel, which can realize high aperture ratio or high resolution.

According to an aspect of the present invention, a switch circuit is provided. The switch circuit is used in a pixel element. The switch circuit includes a first switch and a second switch. The first switch is for being turned on to perform a sample operation on the pixel element. The second switch has three terminals. Among them, a control terminal is coupled to an image data storage capacitor of the pixel element via the first switch. A first data terminal is for being coupled to a corresponding source line of the pixel element. A second data terminal is for being coupled to the image data storage capacitor. When the sample operation is performed, the second switch stores an image data of the image data storage capacitor in a parasitic gate capacitor existing on its control terminal. The stored image data in the second switch is maintained by the parasitic gate capacitor from the sample operation to a refresh operation during which the pixel element is refreshed. The second switch is selectively for electrically connecting its first and second data terminals with each other according to stored image data in the parasitic gate capacitor.

According to another aspect of the present invention, a pixel element is provided. The pixel element is for use in a display panel. The pixel element includes an image data storage capacitor, a gate switch, a first switch, a second switch, and a third switch. The image data storage capacitor is for storing an image data. The gate switch has a control terminal coupled to a corresponding gate line, and two data terminals coupled between a corresponding source line and the image data storage capacitor. The first switch has a control terminal for receiving a sample control signal. The second switch has a control terminal coupled to the image data storage capacitor via the first switch, a first data terminal coupled to the corresponding source line of the pixel element, and a second data terminal coupled to the image data storage capacitor. The third switch has a control terminal for receiving a refresh control signal, and two data terminals coupled between the second switch and the image data storage capacitor. The first switch is turned on to perform a sample operation on the pixel element. The third switch is turned on to perform a refresh operation on the pixel element. When the sample operation is performed, the second switch is for storing an image data of the image data storage capacitor in a parasitic gate capacitor existing on its control terminal. The stored image data in the second switch is maintained by the parasitic gate capacitor from the sample operation to the refresh operation. The second switch is selectively for electrically connecting its first and second data terminals with each other according to stored image data in the parasitic gate capacitor.

According to another aspect of the present invention, a display panel is provided. The display panel includes an active matrix pixel array, a gate driver, and a source driver. The active matrix pixel array includes a number of gate lines, a number of source lines, and a number of pixel elements. The gate driver drives the gate lines. The source driver drives the source lines. The pixel elements are arranged in a matrix. Each pixel element includes an image data storage capacitor, a gate switch, a first switch, a second switch, and a third switch. The image data storage capacitor is for storing an image data. The gate switch has a control terminal coupled to a corresponding gate line, and two data terminals coupled between a corresponding source line and the image data storage capacitor. The first switch has a control terminal for receiving a sample control signal. The third switch is turned on to perform a refresh operation on the pixel element. The second switch has a control terminal coupled to the image data storage capacitor via the first switch, a first data terminal coupled to the corresponding source line of the pixel element, and a second data terminal coupled to the image data storage capacitor. The third switch has a control terminal for receiving a refresh control signal, and two data terminals coupled between the second switch and the image data storage capacitor. The first switch is turned on to perform a sample operation on the pixel element. When the sample operation is performed, the second switch is for storing an image data of the image data storage capacitor in a parasitic gate capacitor existing on its control terminal. The stored image data in the second switch is maintained by the parasitic gate capacitor from the sample operation to the refresh operation. The second switch is selectively for electrically connecting its first and second data terminals with each other according to stored image data in the parasitic gate capacitor.

The above and other aspects of the invention will become better understood with regard to the following detailed description of the preferred but non-limiting embodiment(s). The following description is made with reference to the accompanying drawings.

DETAILED DESCRIPTION OF THE INVENTION

A switch circuit, a pixel element and a display panel are provided in a number of exemplary embodiments as follows. In an embodiment, in order to realize high aperture ratio or high resolution such as pixels per inch (PPI), a parasite gate capacitor existing in a switch is served as a sampling capacitor for use in refreshing a memory in pixel (MIP). Further description is provided as follows with reference to accompanying drawings.

Figure 1:
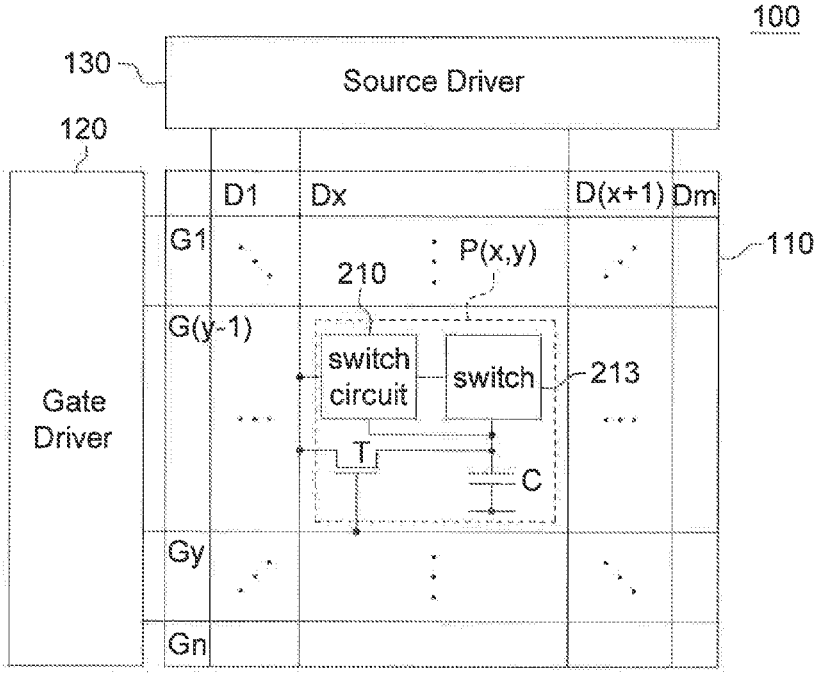
FIG. 1 is a block diagram showing an example of a display panel.

FIG. 1 is a block diagram showing an example of a display panel. The display panel 100 at least includes a display panel 110, a gate driver 120, and a source driver 130. The display panel 100 can be used in display devices. The active matrix pixel array 110 includes a number of gate lines G1-Gn and a number of source lines D1-Dm. The gate driver 120 drives the scan lines G1-Gn. The source driver 130 drives the source lines D1-Dm. The active matrix pixel array 110 further includes a number of pixel elements arranged in a matrix and each being coupled to the corresponding gate line and the corresponding source line. As is made as an example, a pixel element P(x, y) is located at a coordinate position defined by a corresponding source line Dx and a corresponding scan line Gy. In general, the pixel element P(x, y) includes an image data storage capacitor C and a gate switch T. The gate switch T has a control terminal coupled to the corresponding gate line Gy, and two data terminals coupled between the corresponding source line Dx and the image data storage capacitor C. Under control of the gate switch T, the image data storage capacitor C is for receiving and storing an image data therein via the corresponding source line Dx.

Figure 2A:
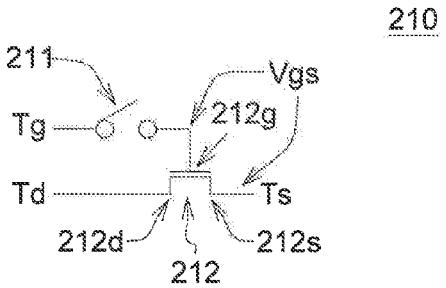
FIG. 2A is a schematic diagram showing an example of a switch circuit according to an embodiment of the invention.

FIG. 2A is a schematic diagram showing an example of a switch circuit according to an embodiment of the invention. The switch circuit 210 is for example used in the pixel element P(x, y) in FIG. 1 The switch circuit 210 includes a first switch 211 and a second switch 212. The second switch 212 has a control terminal 212*g*, and two data terminals 212*s* and 212*d*, which are for example gate, source, and drain terminals, respectively. The control terminal 212*g* is coupled to a terminal Tg of the switch circuit 210 via the first switch 211. The terminal Tg can be for example connected to the image data storage capacitor C of the pixel element P(x, y). The data terminal 212*s* is coupled to a terminal Ts of the switch circuit 210. The terminal Ts can be for example connected to the corresponding source line Dx of the pixel element P(x, y). The data terminal 212*d* is coupled to a terminal Td of the switch circuit 210. The terminal Td can be for example connected to the image data storage capacitor C.

The first switch 211 can be turned on to perform a sample operation on the pixel element P(x, y). When the sample operation is performed, the second switch 212 can be used for storing the image data of the image data storage capacitor C in a parasitic gate capacitor existing on its control terminal 212*g*. For example, when the sample operation is performed, the voltage on a pixel electrode of the image data storage capacitor C is biased at the control terminal 212*g* of the second switch 212 via the turn-on first switch 211. At this time, the parasitic gate capacitor existing on the control terminal 212*g* of the second switch 212 is used to maintain the biased voltage of the control terminal 212*g*. This means the image data of the image data storage capacitor C can be stored in the second switch 212, or more specifically in the parasitic gate capacitor thereof during the sample operation. The stored image data in the second switch 212 is maintained by the parasitic gate capacitor from the sample operation to a refresh operation during which the pixel element P(x, y) is refreshed. The second switch 212 is selectively for electrically connecting its first and second data terminals with each other according to stored image data in the parasitic gate capacitor.

In other words, the second switch 212 reveals not only the characteristic of a switch, but also the one of a capacitive element or a memory for storing image data. In this way, when switch circuit 210 is implemented in the pixel element P(x, y) to form an MIP, the layout area of an extra memory can be saved. As compared with a conventional MIP where a memory or a sampling capacitor is used, the MIP implemented by the pixel element P(x, y) of this disclosure can have less circuit elements, and a reduced circuit complexity. In view of this, high aperture ratio or high resolution can be realized.

Figure 2B:
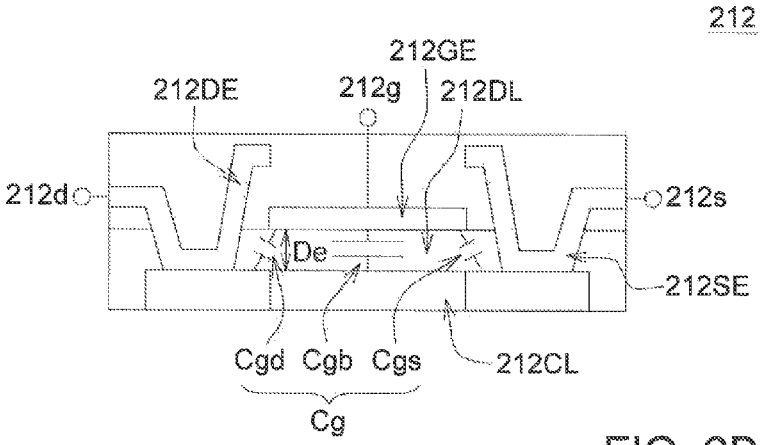
FIG. 2B is a cross-section diagram showing an exemplary structure of the second switch of the switch circuit in FIG. 2A.

FIG. 2B is a cross-section diagram showing an exemplary structure of the second switch of the switch circuit in FIG. 2A. In this exemplary structure, the second switch 212 is exemplified as being implemented by a thin film transistor where its gate, drain, and source terminals 212*g*, 212*d*, and 212*s* are represented by gate, drain, and source electrodes 212GE, 212DE, and 212SE, respectively. In the second switch 212, a parasitic gate capacitor Cg exists on the control terminal 212*g* of the second switch 212, and is a combination of several parasitic capacitors. For example, these parasitic capacitors can be classified as a dielectric capacitor such as a gate-to-body capacitor Cgb, and two fringe capacitors such as a gate-to-drain capacitor Cgd and a gate-to-source capacitor Cgs. The gate-to-body capacitor Cgb is formed between the gate electrode 212GE and a dielectric layer 212DL which separates the gate electrode 212GE from a poly-silicon layer such as a channel layer 212CL. The gate-to-drain capacitor Cgd is formed, at an edge of the gate electrode 212GE, between the gate electrode 212GE and the drain electrode 212DE. The gate-to-source capacitor Cgs is formed, at another edge of the gate electrode 212GE, between the gate electrode 212GE and the source electrode 212SE.

Refer to both FIGS. 2A and 2B. In a case where the first switch 211 is turned on and the gate-to-source voltage Vgs is higher than the threshold voltage of the second switch 212, an inversion layer is formed with electrons accumulated on the surface of the channel layer 212CL. Since the inversion layer is conductive, the gate-to-body capacitor Cgb has a large capacitance. In another case where the first switch 211 is turned off, the absence of the inversion layer causes the channel layer 212CL lose its conductivity, so that the gate-to-body capacitor Cgb becomes a small capacitance.

In order for the second switch 212 to store image data, its parasitic gate capacitance Cg is required to have a capacitance sufficient to maintain the gate-to-source voltage Vgs. In a practical example, the parasitic gate capacitor Vg has a capacitance around a range of dozens of femto-farad (fF), such as 40 fF or 50 fF, but it depends on experience and experimental results and this invention is not limited thereto. Since the gate-to-body capacitor Cgb is small when the first switch 211 is turned off, marinating the gate-to-source voltage Vgs relies on the fringe capacitance such as the gate-to-drain capacitor Cgd or the gate-to-source capacitor Cgs. Applicants found that the capacitances of the gate-to-drain capacitor Cgd and the gate-to-source capacitor Cgs are related to a number of factors, which at least include the width of the channel layer 212CL, the depth De or the permittivity of the dielectric layer 212DL, and a layout area or a dimensional size of the second switch 212. Therefore, by adjusting at least one of these related factors, it is able to implement a switch having a parasitic capacitor whose capacitance is sufficient to stably maintain the gate-to-source voltage Vgs.

Figure 3A:
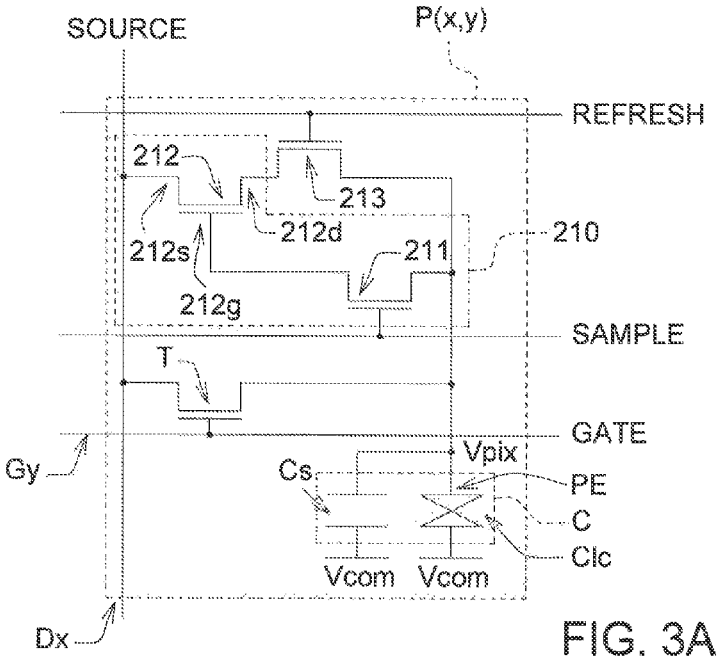
FIG. 3A is a schematic diagram showing a pixel element for use in a display panel according to an embodiment of the invention.

FIG. 3A is a schematic diagram showing a pixel element for use in a display panel according to an embodiment of the invention. Substituting the pixel element P(x, y) in FIG. 3A for that in FIG. 1 achieves a display panel according to an embodiment of the invention, and a detailed schematic diagram of which is omitted for the sake of brevity. In FIG. 3A, the pixel element P(x, y) includes an image data storage capacitor C and a gate switch T which are similar to that in FIG. 1, while the image data storage capacitor C is exemplarily represented by a combination of two capacitors such as a liquid crystal capacitor Clc and a storage capacitor Cs.

The pixel element P(x, y) further includes a first switch 211, a second switch 212, and a third switch 213. The first switch 211 has a control terminal for receiving a sample control signal SAMPLE. The second switch 212 has a control terminal 212*g* coupled to a pixel electrode (denoted as a node PE) of the image data storage capacitor C via the first switch 211. The second switch 212 further has a first data terminal 212*s* coupled to the corresponding source line Dx of the pixel element P(x, y), and a second data terminal 212*d* coupled to the image data storage capacitor C via the third switch 213. The third switch 213 has a control terminal for receiving a refresh control signal REFRESH, and two data terminals coupled between the second switch 212 and the image data storage capacitor C. In practice, the pixel element P(x, y) is referred to as an MIP with 4 T, i.e., four switches, one of which, i.e., the second switch 212 in this example, has both the characteristics of a switch and a capacitive element or a memory for the MIP.

In this pixel element P(x, y), there is a parasitic gate capacitance existing on the control terminal of the second switch 212. The parasitic gate capacitor is designed as being sufficient to maintain the biased voltage of the control terminal 212*g*. Therefore, the second switch 212 can be regarded as having an equivalent circuit of a switch, as well as a capacitive element or a memory connected between for example its control terminal 212*g* and the corresponding source line Dx. In this way, an extra memory between the control terminal 212*g* and the corresponding source line Dx can be saved, thus realizing high aperture ratio or high resolution.

In a practical example, in order to realize high aperture ratio, these switches 211, 212, and 213 are for example about their minimal acceptable dimensional sizes. At this time, the second switch 212 has its physical structure different from that of the first and third switches 211 and 213 since it serves not only a switch but also a capacitive element. In correspondence thereto, the second switch 212 may have a parasitic gate capacitor whose capacitance is for example larger than that of the two switches 211 and 213, but smaller than that of the image data storage capacitor C.

In an embodiment, these switches 211, 212, and 213 can be implemented by thin film transistors as in FIG. 2B. In this embodiment, the second switch 212 can have a channel layer such as the channel layer 212CL in FIG. 2B, whose width is larger than that of the first switch 211 or the third switch 213. In other words, referring to FIG. 2B, the channel layer 212CL can be extended toward a direction such as the direction pointed into or out of the page, so can the gate electrode 212GE. In another embodiment, the second switch 212 can have a dielectric layer such as the dielectric layer 212DL in FIG. 2B, whose depth is larger than that of the first switch 211 or the third switch 213. In another embodiment, the second switch 212 can have a dielectric layer such as the dielectric layer 212DL in FIG. 2B, whose permittivity is lower than that of the first switch 211 or the third switch 213. In another embodiment, the second switch 212 has a layout area larger than that of the first switch 211 or the third switch 213. In these embodiments, the fringe capacitor such as the gate-to-source capacitor Cgs or the gate-to-drain capacitor Cgd of the second switch 212 can have a larger capacitance, thus assuring that the voltage of the control terminal of the second switch 212 can be maintained.

Figure 3B:
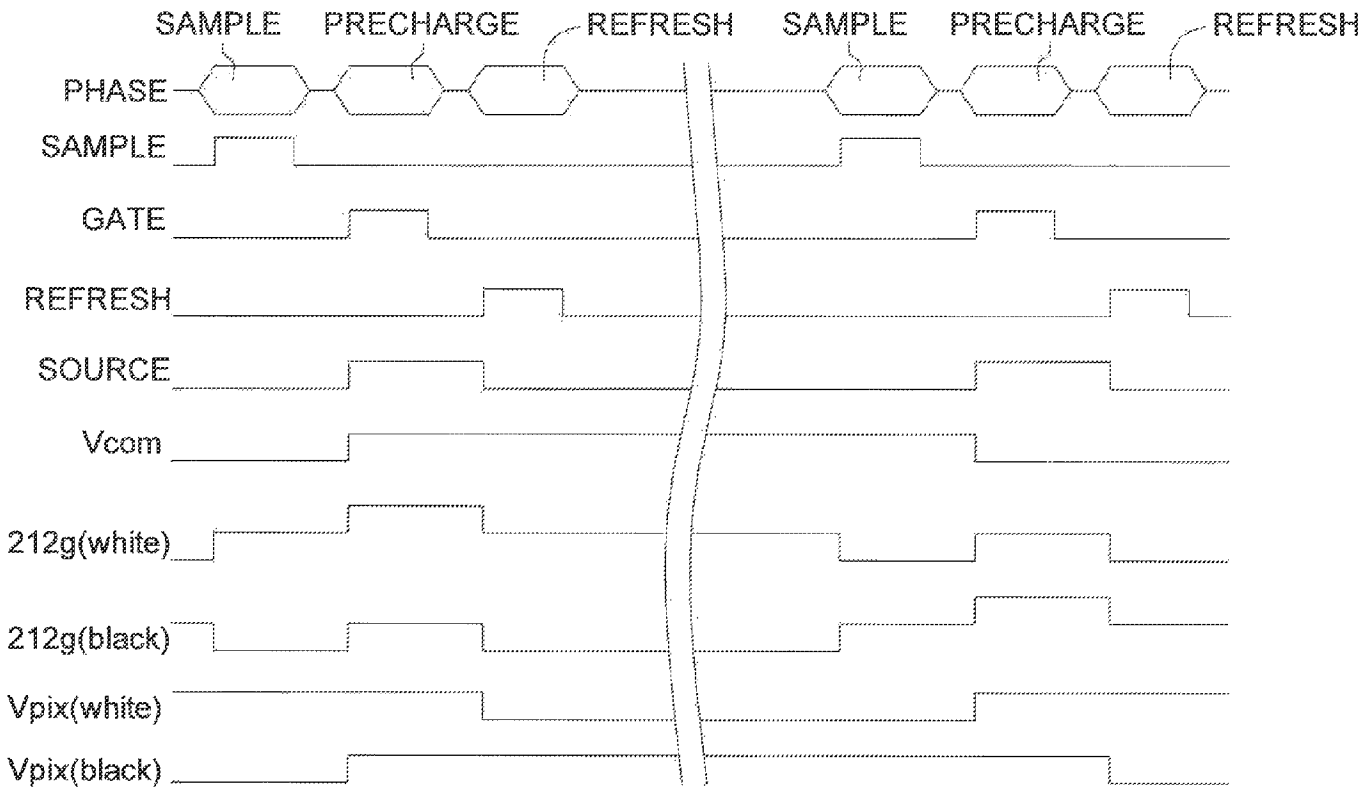
FIG. 3B is a timing diagram showing an example of a number of signal waveforms for use in the pixel element in FIG. 3A.

FIG. 3B is a timing diagram showing an example of a number of signal waveforms for use in the pixel element in FIG. 3A. In this example, the sample control signal SAMPLE, a gate control signal GATE, and the refresh control signal REFRESH are sequentially enabled, causing the first switch 211, the gate switch T, and the third switch 213 sequentially turned on to perform a sample operation, a precharge operation, and a refresh operation on the pixel element P(x, y) at different phases. As for an image data of binary high or low, white or black, the pixel voltage Vpix on the pixel electrode PE of the image data storage capacitor C can be of two voltage states, such as a pixel voltage Vpix(white) for binary high image data and a pixel voltage Vpix(black) for binary low image data. As such, the sample operation, the precharge operation, and the refresh operation are sequentially performed to refresh the image data storage capacitor C, or maintain its image data at its original state.

More specifically, the operation of refreshing the pixel element P(x, y) in FIG. 3A in view of the signals in FIG. 3B is as follows, where the pixel voltage Vpix(white) for binary high image data is made as an example for illustration. First, prior to a sample phase in FIG. 3B, the pixel voltage Vpix (white) is for example initially 5V and the common voltage Vcom is for example initially 0V. Then, refer to the sample operation, where the sample control signal SAMPLE is enabled to turn on the first switch 211, and the control terminal 212*g* of second switch 212 is biased at about 5V, as shown by the voltage 212*g*(white). The voltage 212*g*(white) on the control terminal 212*g* is maintained by the parasitic gate capacitor between two terminals 212*g* and 212*s* of the second switch 212. In view of this, during the sample phase, the second switch 212 is served or behaves as a capacitor for storing the image data.

Then, refer to a precharge phase in FIG. 3B. The gate control signal GATE is enabled at a high level to turn on the gate switch T. The refresh data signal SOURCE is enabled at a high level of, for example, 5V. Via the turn-on gate switch T, the enabled refresh data signal SOURCE of 5V is provided to maintain the pixel voltage Vpix of 5V at 5V, while the common voltage Vcom is flipped at this time. Thus, the image data storage capacitor C is neutralized, i.e., the voltage applied thereacross is 0V. Plus, the source data signal SOURCE is transited from low to high level. Via the parasitic gate capacitor between two terminals 212*g* and 212*s* of the second switch 212, the voltage 212*g*(white) on the control terminal 212*g* is varied with the source data signal SOURCE. Thus, the voltage 212*g*(white) is pushed up to about 10V during the precharge phase.

After that, refer to a refresh phase in FIG. 3B. The refresh control signal REFRESH is enabled at a high level to turn on the third switch 213. At this time, the voltage 212*g*(white) is pushed down to about 5V during the refresh phase. This voltage 212*g*(white) is still enough to turn on the second switch 212 since the voltage difference between two terminals 212*s* and 212*g* is higher than the threshold voltage of the second switch 212. Specifically, the second switch 212 is turned on since the voltage difference of 4.5V (212*g*(white)−SOURCE=5V−0V) is higher than its threshold voltage of 1V. Via the turn-on second and third switches 212 and 213, the refresh data signal SOURCE of 0V is provided to bias the pixel voltage Vpix at 5V. Thus, the image data is refreshed while its polarity inversed, as can be seen from FIG. 3B, where "Vpix(white), Vcom"="5V, 0V" in the refresh phase, and "Vpix(white), Vcom"="0V, 5V" in the sample phase.

Analogically, the pixel voltage Vpix(black) for binary low image data can also be refreshed properly, as can be seen from FIG. 3B, where "Vpix(black), Vcom"="5V, 5V" in the refresh phase, and "Vpix(black), Vcom"="0V, 0V" in the sample phase. As for the pixel voltage Vpix(white) for binary low image data, its detailed operation, thus, can be conducted by one of ordinary skill in the art when referring to the above-related description for binary high image data, and will not be specified for the sake of brevity.

In view of aforementioned description for the operation of the pixel element P(x, y), the second switch 212 is not only served or behaves as a switch element but also a capacitor for storing image data. Therefore, the second switch 212 can be regarded as having an equivalent circuit of a switch, as well as a capacitive element or a memory connected between for example its control terminal 212*g* and the corresponding source line Dx. In this way, an extra memory between the control terminal 212*g* and the corresponding source line Dx can be saved, thus realizing high aperture ratio or high resolution.

Figure 4A:
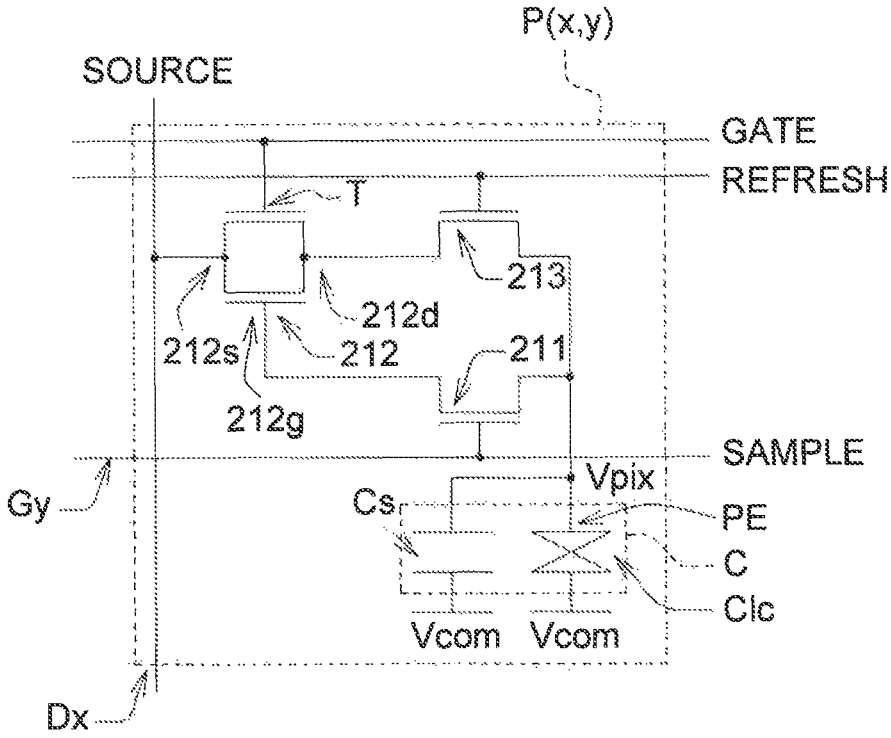
FIG. 4A is a schematic diagram showing a pixel element for use in a display panel according to another embodiment of the invention.
Figure 4B:
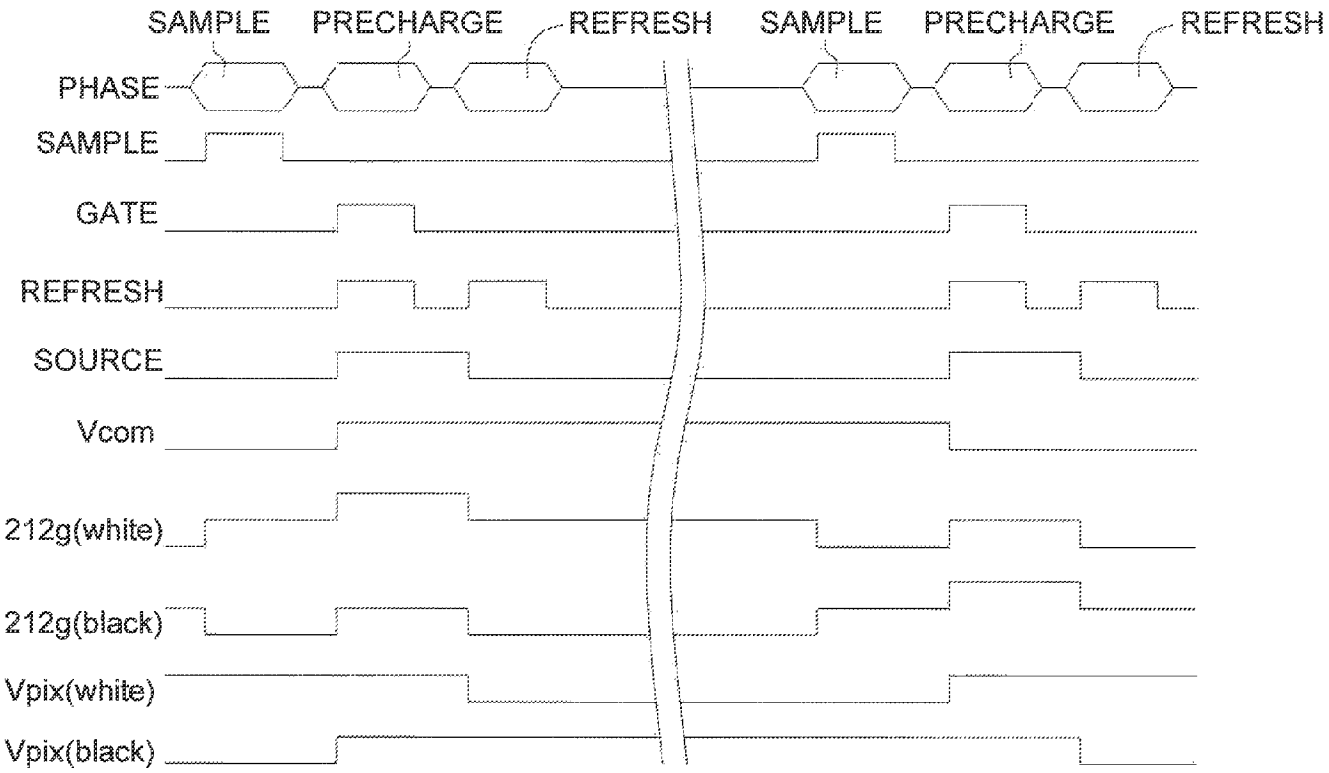
FIG. 4B is a timing diagram showing another example of a number of signal waveforms for use in the pixel element in FIG. 4A.

FIG. 4A is a schematic diagram showing a pixel element for use in a display panel according to another embodiment of the invention. FIG. 4B is a timing diagram showing another example of a number of signal waveforms for use in the pixel element in FIG. 4A. The pixel element P(x, y) in FIG. 4A differs with the pixel element P(x, y) in FIG. 3A in that the second switch 212 has its two data terminals 212*s* and 212*d* electrically connected with the two data terminals of the gate switch T. The signal waveforms in FIG. 4B differ with that in FIG. 4A is that the refresh control signal REFRESH is enabled during the precharge operation. Employing the proper control signals as shown in FIG. 4B, the pixel element P(x, y) in FIG. 4A have the similar performance as that in FIG. 3A, its operation, thus, will not be specified for the sake of brevity.

According to the switch circuit, the pixel element and the display panel disclosed in the embodiments of the invention, a parasite gate capacitor existing in a switch is served as a memory for use in an MIP. In this way, high aperture ratio, or high resolution can be realized.

While the invention has been described by way of example and in terms of the preferred embodiment(s), it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A switch circuit for use in a pixel element, the switch circuit comprising:

a first switch for being turned on to perform a sample operation on the pixel element; and a second switch having:

a control terminal coupled to an image data storage capacitor of the pixel element via the first switch;

a first data terminal for being coupled to a corresponding source line of the pixel element; and a second data terminal for being coupled to the image data storage capacitor, wherein when the sample operation is performed, the second switch is for storing image data of the image data storage capacitor in a parasitic gate capacitor whose capacitance is larger than that of the first switch but smaller than that of the image data storage capacitor, between the control terminal and the first data terminal existing on its control terminal, the image data stored in the second switch is maintained by the parasitic gate capacitor between the control terminal and the first data terminal from the sample operation to a refresh operation during which the pixel element is refreshed; and the second switch is selectively for electrically connecting its first and second data terminals with each other according to image data stored in the parasitic gate capacitor since a voltage difference between the control terminal and the first data terminal is higher than a threshold voltage of the second switch during a refresh phase.

2. The switch circuit according to claim 1, wherein the second switch has a channel layer whose width is larger than that of the first switch.

3. The switch circuit according to claim 1, wherein the second switch has a dielectric layer whose depth is larger than that of the first switch.

4. The switch circuit according to claim 1, wherein the second switch has a dielectric layer whose permittivity is lower than that of the first switch.

5. The switch circuit according to claim 1, wherein the second switch has a layout area larger than that of the first switch.

6. A pixel element for use in a display panel, the pixel element comprising:

an image data storage capacitor for storing image data;

a gate switch having a control terminal coupled to a corresponding gate line, and two data terminals coupled between a corresponding source line and the image data storage capacitor;

a first switch having a control terminal for receiving a sample control signal;

a second switch having a control terminal coupled to the image data storage capacitor via the first switch, a first data terminal coupled to the corresponding source line of the pixel element, and a second data terminal coupled to the image data storage capacitor; and a third switch having a control terminal for receiving a refresh control signal, and two data terminals coupled between the second switch and the image data storage capacitor, wherein the first switch is turned on to perform a sample operation on the pixel element, and the third switch is turned on to perform a refresh operation on the pixel element; when the sample operation is performed; the second switch is for storing an image data of the image data storage capacitor in a parasitic gate capacitor whose capacitance is larger than that of the first switch but smaller than that of the image data storage capacitor, between the control terminal and the first data terminal existing on its control terminal, the image data stored in the second switch is maintained by the parasitic gate capacitor between the control terminal and the first data terminal from the sample operation to the refresh operation, and the second switch is selectively for electrically connecting its first and second data terminals with each other according to image data stored in the parasitic gate capacitor since a voltage difference between the control terminal and the first data terminal is higher than a threshold voltage of the second switch during a refresh phase.

7. The pixel element according to claim 6, wherein the second switch has a channel layer whose width is larger than that of the first switch or the third switch.

8. The pixel element according to claim 6, wherein the second switch has a dielectric layer whose depth is larger than that of the first switch or the third switch.

9. The pixel element according to claim 6, wherein the second switch has a dielectric layer whose permittivity is lower than that of the first switch or the third switch.

10. The pixel element according to claim 6, wherein the second switch has a layout area larger than that of the first switch or the third switch.

11. The pixel element according to claim 6, wherein the second switch has its two data terminals electrically connected with the two data terminals of the gate switch.

12. A display panel, comprising:

an active matrix pixel array comprising:

a plurality of gate lines;

a plurality of source lines;

a plurality of pixel elements arranged in a matrix, each pixel element being coupled to the corresponding gate line and source line, each pixel element as claimed in claim 6;

a gate driver for driving the gate lines; and a source driver for driving the source lines.

13. The display panel according to claim 12, wherein the second switch has a channel layer whose width is larger than that of the first switch or the third switch.

14. The display panel according to claim 12, wherein the second switch has a dielectric layer whose depth is larger than that of the first switch or the third switch.

15. The display panel according to claim 12, wherein the second switch has a dielectric layer whose permittivity is lower than that of the first switch or the third switch.

16. The display panel according to claim 12, wherein the second switch has a layout area larger than that of the first switch or the third switch.

17. The display panel according to claim 12, wherein the second switch has its two data terminals electrically connected with the two data terminals of the gate switch.

* * * * *